US009824793B2

(12) United States Patent
Nakatani et al.

(10) Patent No.: US 9,824,793 B2
(45) Date of Patent: Nov. 21, 2017

(54) NOISE REDUCTION CABLE

(71) Applicant: Hitachi Metals, Ltd., Tokyo (JP)

(72) Inventors: Katsutoshi Nakatani, Hitachi (JP); Yosuke Sumi, Hitachinaka (JP); Kenji Ajima, Hitachiota (JP); Katsuya Akimoto, Hitachi (JP); Hiroshi Okikawa, Hitachi (JP); Mamoru Ohashi, Hitachi (JP); Yasunori Suzuki, Tokai-mura (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/170,714

(22) Filed: Jun. 1, 2016

(65) Prior Publication Data

US 2016/0358694 A1 Dec. 8, 2016

(30) Foreign Application Priority Data

Jun. 2, 2015 (JP) ..... 2015-112484

(51) Int. Cl.
*H01B 7/00* (2006.01)
*H01B 9/02* (2006.01)

(52) U.S. Cl.
CPC ..... *H01B 9/021* (2013.01); *H01B 9/028* (2013.01)

(58) Field of Classification Search
USPC ..... 174/36, 102 R, 110 R, 113 R
See application file for complete search history.

(56) References Cited

U.S. PATENT DOCUMENTS 6,225,565 B1 * 5/2001 Prysner ..... H01B 9/027 174/120 SC
2008/0099239 A1 * 5/2008 Fong ..... H01B 11/1083 174/391
2014/0166335 A1 * 6/2014 Kagoura ..... H01B 7/045 174/107

FOREIGN PATENT DOCUMENTS

JP 05-325658 A * 12/1993 ..... H01B 9/02
JP H05-325658 A 12/1993

OTHER PUBLICATIONS

Extended European Search Report dated Oct. 5, 2016.

* cited by examiner

*Primary Examiner* — William H Mayo, III
(74) *Attorney, Agent, or Firm* — McGinn IP Law Group, PLLC

(57) ABSTRACT

A noise reduction cable includes a plurality of insulated wires, each including a conductor and an insulator that covers a periphery of the conductor; and one or more drain wires, each including a conductor, an insulator that covers a periphery of the conductor, and a magnetic-material layer provided on a periphery of the insulator.

20 Claims, 8 Drawing Sheets

NOISE REDUCTION CABLE

The present application is based on Japanese patent application No. 2015-112484 filed on Jun. 2, 2015, the entire contents of which are incorporated herein by reference.

BACKGROUND OF THE INVENTION

1. Field of the Invention

The present invention relates to a noise reduction cable.

2. Description of the Related Art

Japanese Unexamined Patent Application Publication No. 5-325658, for example, proposes an electromagnetic shielding cable that prevents noise generated due to variable speed control of an alternating-current motor from leaking to the outside.

The electromagnetic shielding cable includes three electric wires that supply a three-phase alternating current to the motor, each electric wire being covered with a sub-shielding layer; three drain wires that are disposed between the electric wires, each drain wire including a conductor and a semiconductor resin that covers the periphery of the conductor; and a main shielding layer that covers the electric wires and the drain wires with an insulating separator interposed therebetween. The sub-shielding layer is composed of a laminated tape made of aluminum and either nylon or polyester. The main shielding layer has a two-layer structure including a copper tape layer and an iron tape layer.

Since the electromagnetic shielding cable of the related art includes the main shielding layer at the periphery thereof, the cable is not satisfactorily flexible.

SUMMARY OF THE INVENTION

In view of the foregoing and other exemplary problems, drawbacks, and disadvantages of the conventional methods and structures, an exemplary feature of the present invention is to provide noise reduction cable.

Accordingly, an object of the present invention is to provide a highly flexible noise reduction cable having the desired electromagnetic-noise reduction effect.

[1] A noise reduction cable including a plurality of insulated wires, each including a conductor and an insulator that covers a periphery of the conductor; and one or more drain wires, each including a conductor, an insulator that covers a periphery of the conductor, and a magnetic-material layer provided on a periphery of the insulator.

[2] The noise reduction cable according to [1], wherein the plurality of insulated wires and the one or more drain wires are arranged at positions that are line-symmetrical with respect to a line passing through a center of a cross section of the cable, and are twisted together.

[3] The noise reduction cable according to [1] or [2], wherein a plurality of the magnetic-material layers are provided with a predetermined interval therebetween.

The present invention provides a highly flexible noise reduction cable having the desired electromagnetic-noise reduction effect.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE PREFERRED EMBODIMENTS

Figure 1:
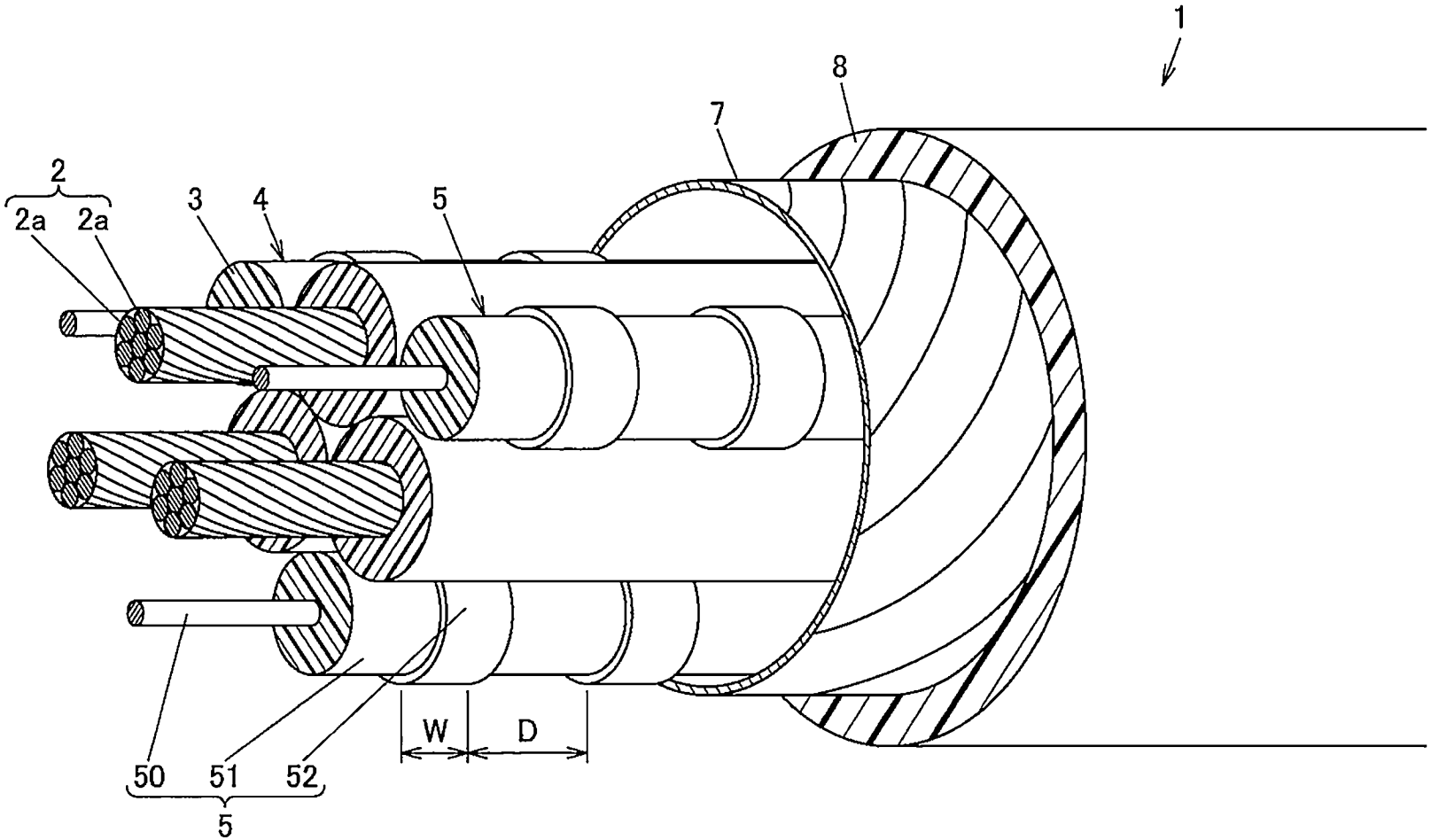
FIG. 1 is a schematic perspective view illustrating the structure of a noise reduction cable according to a first embodiment of the present invention.

Referring now to the drawings, and more particularly to FIGS. 1-9, there are shown exemplary embodiments of the structures according to the present invention.

Embodiments of the present invention will be described with reference to the drawings. In each figure, components having substantially the same functions are denoted by the same reference numerals, and redundant description thereof is thus omitted.

First Embodiment

Figure 2:
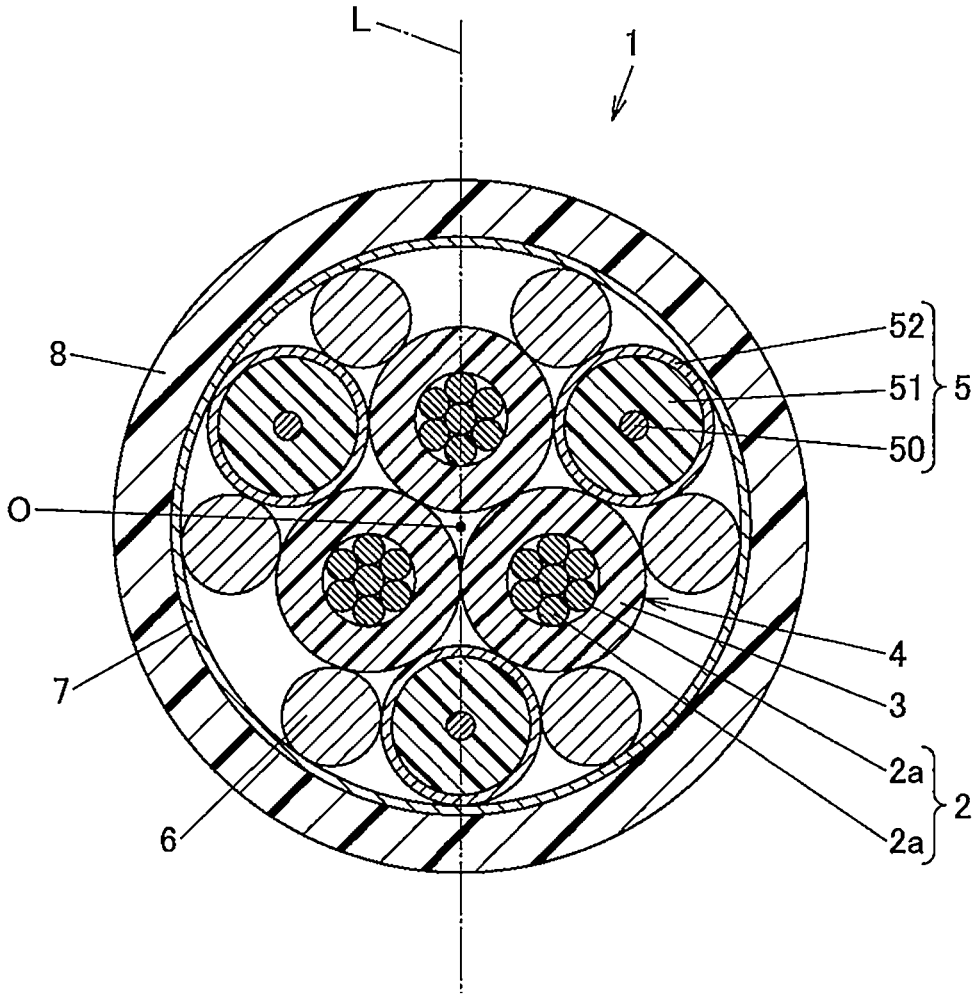
FIG. 2 is a cross sectional view of the noise reduction cable illustrated in FIG. 1.

FIG. 1 is a schematic perspective view illustrating the structure of a noise reduction cable 1 according to a first embodiment of the present invention. FIG. 2 is a cross sectional view of the noise reduction cable 1 illustrated in FIG. 1. FIG. 1 does not show the state in which insulated wires 4 and drain wires 5 are stranded. In FIG. 1, interposed objects 6 are not illustrated.

The noise reduction cable 1 includes three insulated wires 4, each including a conductor 2 and an insulator 3 that covers the periphery of the conductor 2; a plurality of drain wires 5 (three drain wires 5 in the present embodiment) disposed between the insulated wires 4; a resin tape layer 7 formed by wrapping a resin tape around the insulated wires 4, the drain wires 5, and the interposed objects 6 in a stranded state; and a sheath 8 that is provided at the periphery of the resin tape layer 7 and that serves as an insulating protective layer made of a resin or the like. The number of drain wires 5 is not limited to three, and may instead be one, two, or four or more.

The conductor 2 is formed by twisting a plurality of thin metal wires 2*a* (seven thin metal wires 2*a* in the present embodiment) together. The three insulated wires 4 transmit, for example, a three-phase alternating-current voltage from an inverter to a motor. The conductor 2 may instead be formed of a single wire. Although three insulated wires 4 are provided in the present embodiment, the number of insulated wires 4 may instead be four.

The three insulated wires 4, the three drain wires 5, and six interposed objects 6 are arranged at positions that are line-symmetrical with respect to a line L that passes through the center O of the cross section of the cable 1, and are twisted together. Since the insulated wires 4, the drain wires 5, and the interposed objects 6 are arranged symmetrically, they may be easily twisted together.

The interposed objects 6 are, for example, flexible rod-shaped members made of a resin or the like and having a circular cross section.

The resin tape layer 7 is formed by wrapping a resin tape around the insulated wires 4, the drain wires 5, and the interposed objects 6 in a stranded state in a longitudinal direction of the cable. The resin tape that forms the resin tape layer 7 may be made of a resin such as polyethylene terephthalate (PET) or a polypropylene based resin.

Structure of Drain Wires 5

Each drain wire 5 includes a conductor 50, an insulator 51 provided on the periphery of the conductor 50, and a plurality of magnetic tape layers 52 provided on the periphery of the insulator 51. The magnetic tape layers 52 have a predetermined width W and are arranged in the longitudinal direction of the cable with predetermined intervals D therebetween. The drain wires 5 are connected to a ground terminal of an inverter or motor. The magnetic tape layers 52 are examples of magnetic-material layers.

The magnetic tape layers 52 are formed by wrapping pieces of magnetic tape having the width W around the insulator 51 so that both ends of each piece of magnetic tape overlap, and bonding the overlapping portions together by resistance welding. The width W of the magnetic tape is, for example, preferably in the range of 5 to 50 mm. The intervals D between the magnetic tape layers 52 are, for example, preferably in the range of 5 to 50 mm.

The magnetic tape is preferably made of a soft magnetic material having a low coercive force and a high magnetic permeability to reduce electromagnetic noise. The soft magnetic material may be, for example, an amorphous alloy, such as a Co-based amorphous alloy or a Fe-based amorphous alloy, a ferrite, such as a Mn—Zn-based ferrite, a Ni—Zn-based ferrite, or a Ni—Zn—Cu-based ferrite, or a soft magnetic metal, such as a Fe—Ni-based alloy (Permalloy), a Fe—Si—Al-based alloy (Sendust), or a Fe—Si-based alloy (silicon steel).

Effects and Advantages of First Embodiment

The present embodiment provides the following effects and advantages.

(1) When electromagnetic noise is radiated from the insulated wires 4, noise currents flow through the conductors 50 of the drain wires 5. The noise currents are reduced by the magnetic tape layers 52 of the drain wires 5 having increased impedances. Accordingly, radiation of the electromagnetic noise to the outside of the noise reduction cable 1 is suppressed.

(2) Since the magnetic tape layers 52 are provided on each of the drain wires 5, the bendability (flexibility) is higher than that in the case where a shield layer and a magnetic-material layer are provided at the periphery of the cable. In addition, since the magnetic tape layers 52 having a predetermined width are provided on the drain wires 5 with intervals therebetween in the longitudinal direction of the cable, the bendability is higher than that in the case where the magnetic tape layers 52 are provided on the drain wires 5 so as to extend over the entireties of the drain wires 5 in the longitudinal direction of the cable.

(3) Since the magnetic tape layers 52 are provided on portions of the drain wires 5 instead of providing a shield layer and a magnetic-material layer at the periphery of the cable, the bendability is increased and the desired electromagnetic-noise reduction effect can be obtained.

Second Embodiment

Figure 3:
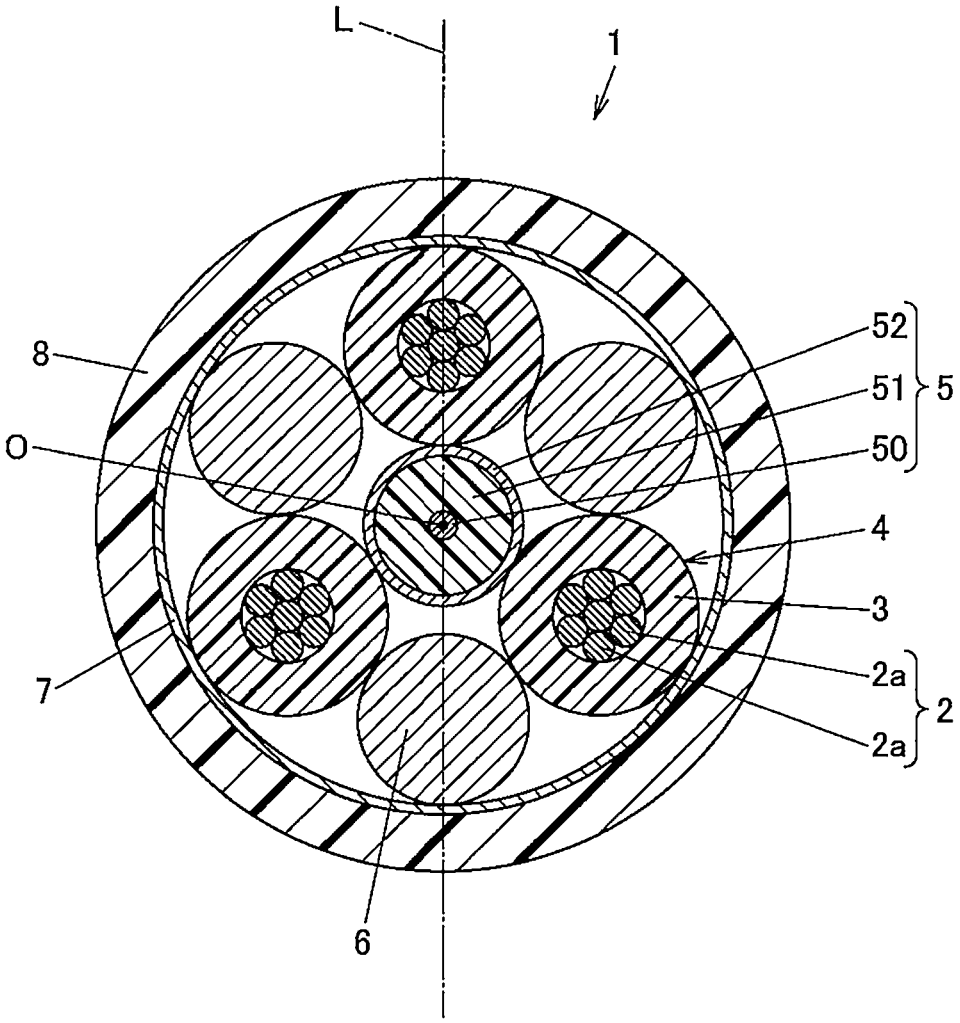
FIG. 3 is a cross sectional view of a noise reduction cable according to a second embodiment of the present invention.

FIG. 3 is a cross sectional view of a noise reduction cable according to a second embodiment of the present invention. Although three drain wires 5 are provided in the first embodiment, only one drain wire 5 is provided in the present embodiment. Other structures are similar to those in the first embodiment. Differences from the first embodiment will be mainly described.

A noise reduction cable 1 according to the present embodiment includes a single drain wire 5 disposed at the center, three insulated wires 4 arranged around the drain wire 5, a resin tape layer 7 provided around the insulated wires 4, the drain wire 5, and interposed objects 6 in a stranded state, and a sheath 8 provided at the periphery of the resin tape layer 7.

The three insulated wires 4, the drain wire 5, and three interposed objects 6 are arranged at positions that are line-symmetrical with respect to a line L that passes through the center O of the cross section of the cable 1, and are twisted together.

Since the insulated wires 4, the drain wire 5, and the interposed objects 6 are arranged symmetrically, they may be easily twisted together. In addition, since the total number of strands is smaller than that in the first embodiment, also in the present embodiment, the bendability is increased and the desired electromagnetic-noise reduction effect can be obtained.

Third Embodiment

Figure 4:
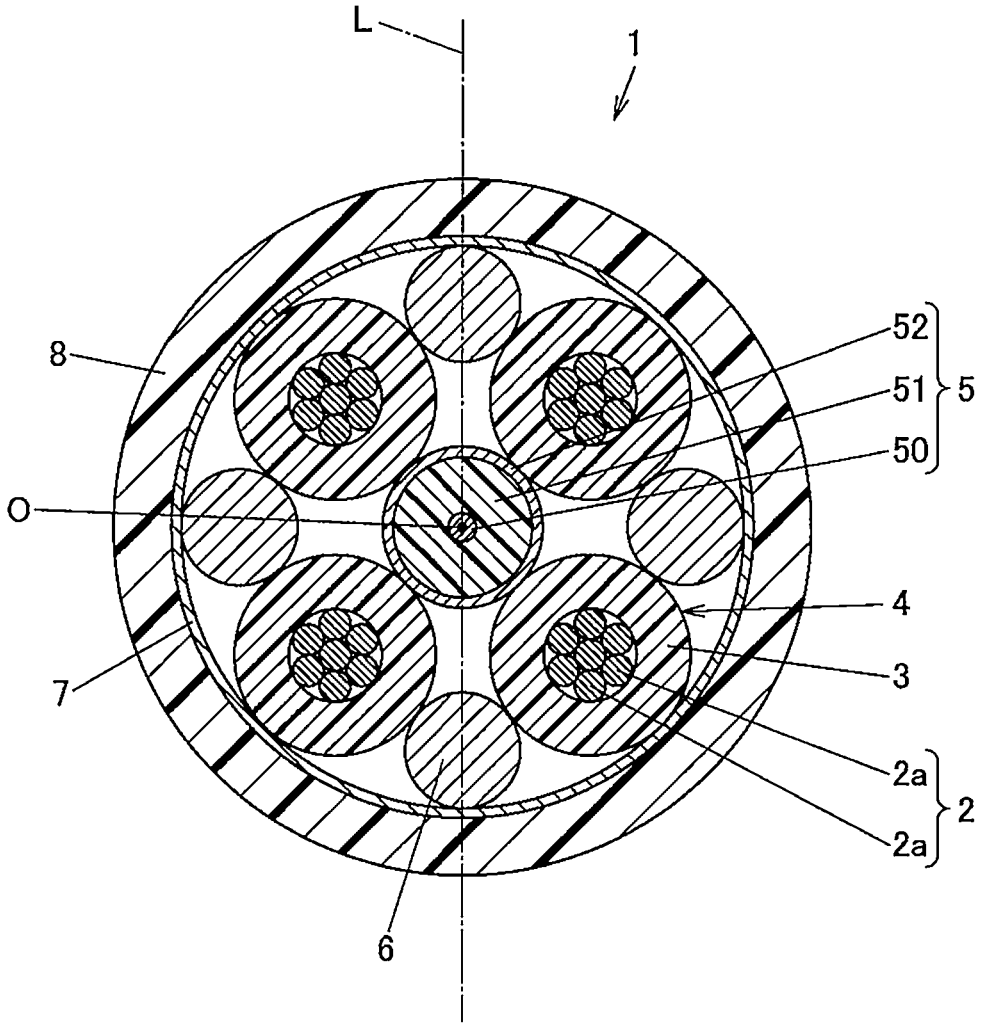
FIG. 4 is a cross sectional view of a noise reduction cable according to a third embodiment of the present invention.

FIG. 4 is a cross sectional view of a noise reduction cable according to a third embodiment of the present invention. Although three drain wires 5 and three insulated wires 4 are provided in the first embodiment, only one drain wire 5 and four insulated wires 4 are provided in the present embodiment. Other structures are similar to those in the first embodiment. Differences from the first embodiment will be mainly described.

A noise reduction cable 1 according to the present embodiment includes a single drain wire 5 disposed at the center, four insulated wires 4 arranged around the drain wire 5, a resin tape layer 7 provided around the insulated wires 4, the drain wire 5, and interposed objects 6 in a stranded state, and a sheath 8 provided at the periphery of the resin tape layer 7.

The four insulated wires 4, the drain wire 5, and four interposed objects 6 are arranged at positions that are line-symmetrical with respect to a line L that passes through the center O of the cross section of the cable 1, and are twisted together.

Since the insulated wires 4, the drain wire 5, and the interposed objects 6 are arranged symmetrically, they may be easily twisted together. In addition, since the total number of strands is smaller than that in the first embodiment, also in the present embodiment, the bendability is increased and the desired electromagnetic-noise reduction effect can be obtained. In addition, since the cable of the present embodiment is a four-core cable, not only a three-phase alternating-current voltage but also a control signal can be transmitted from an inverter to a motor.

Fourth Embodiment

Figure 5:
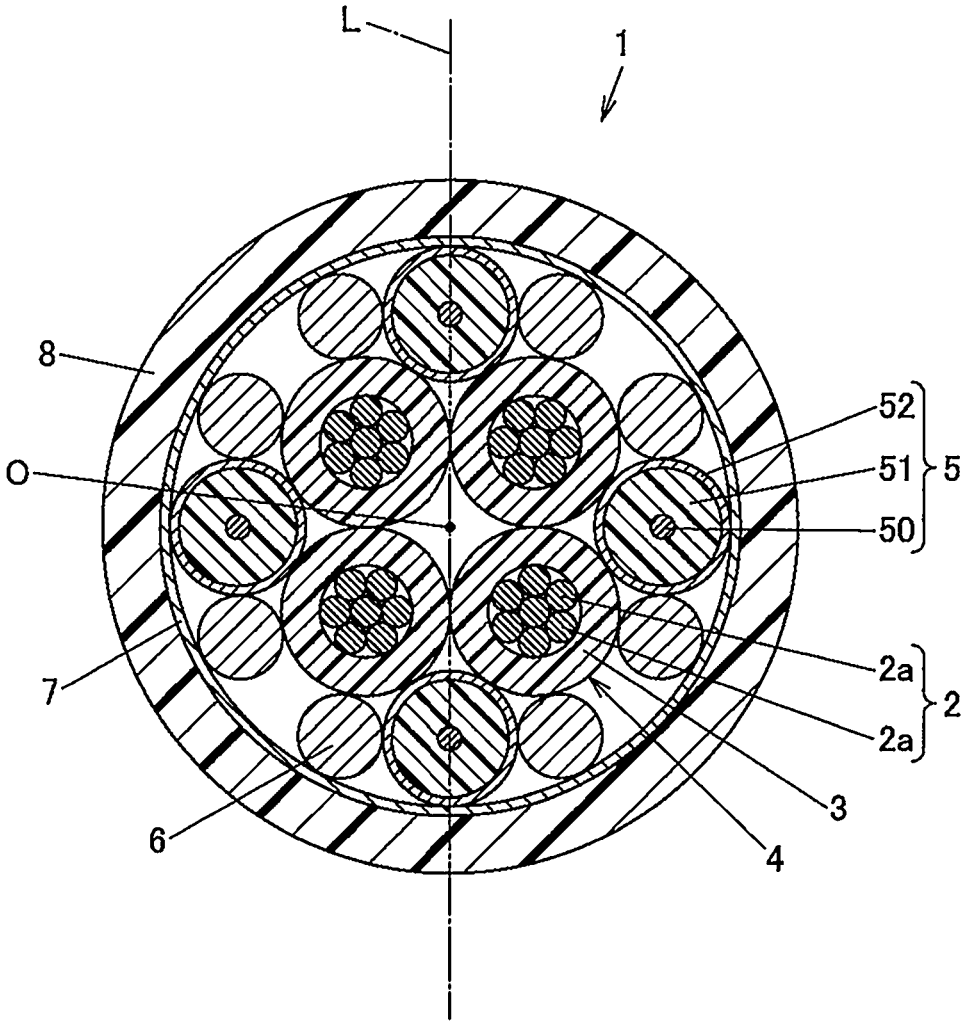
FIG. 5 is a cross sectional view of a noise reduction cable according to a fourth embodiment of the present invention.

FIG. 5 is a cross sectional view of a noise reduction cable according to a fourth embodiment of the present invention.

Although three drain wires 5 and three insulated wires 4 are provided in the first embodiment, four insulated wires 4 and four drain wire 5 are provided in the present embodiment. Other structures are similar to those in the first embodiment. Differences from the first embodiment will be mainly described.

A noise reduction cable 1 according to the present embodiment includes four insulated wires 4, four drain wires 5 disposed between the insulated wires 4, a resin tape layer 7 provided around the insulated wires 4, the drain wires 5, and interposed objects 6 in a stranded state, and a sheath 8 provided at the periphery of the resin tape layer 7.

The four insulated wires 4, the four drain wires 5, and eight interposed objects 6 are arranged at positions that are line-symmetrical with respect to a line L that passes through the center O of the cross section of the cable 1, and are twisted together.

Since the insulated wires 4, the drain wire 5, and the interposed objects 6 are arranged symmetrically, they may be easily twisted together. Although the total number of strands is greater than that in the first embodiment, also in the present embodiment, the bendability is increased and the desired electromagnetic-noise reduction effect can be obtained. In addition, since the cable of the present embodiment is a four-core cable, not only a three-phase alternating-current voltage but also a control signal can be transmitted from an inverter to a motor.

Example

Figure 6C:
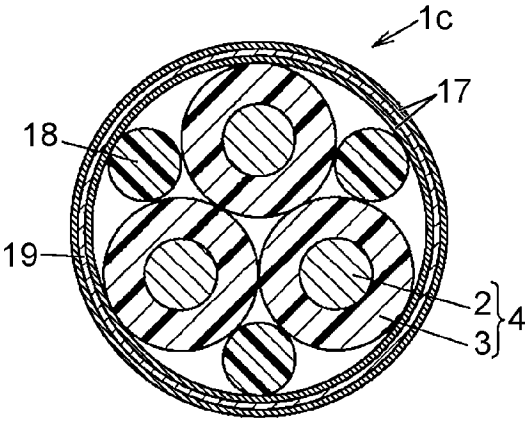
FIG. 6C is a sectional view of a cable according to Comparative Example 2.
Figure 6B:
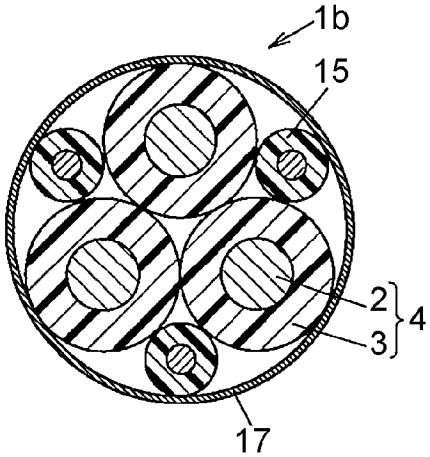
FIG. 6B is a sectional view of a cable according to Comparative Example 1.
Figure 6A:
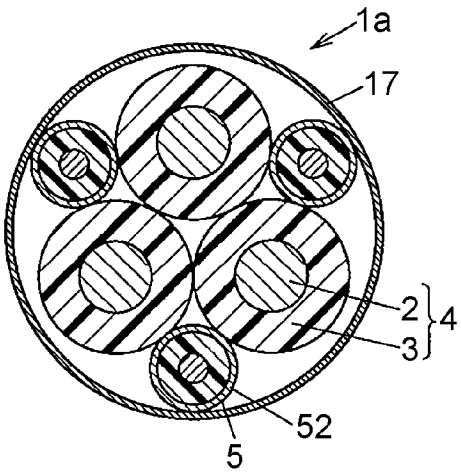
FIG. 6A is a sectional view of a cable according to Example.

FIG. 6A is a sectional view of a cable 1*a* according to Example, FIG. 6B is a sectional view of a cable 1*b* according to Comparative Example 1, and FIG. 6C is a sectional view of a cable 1*c* according to Comparative Example 2.

The cable 1*a* according to Example corresponds to the cable of the first embodiment, and was formed by arranging three drain wires 5 including magnetic tape layers 52 between three insulated wires 4 and wrapping a polyethylene tape 17 around the insulated wires 4 and the drain wires 5 in a stranded state.

The cable 1*b* according to Comparative Example 1 was formed by arranging three drain wires 15 that do not include magnetic tape layers 52 between three insulated wires 4 and wrapping a polyethylene tape 17 around the insulated wires 4 and the drain wires 15 in a stranded state.

The cable 1*c* according to Comparative Example 2 was formed by arranging three interposed objects 18 between three insulated wires 4, wrapping a polyethylene tape 17 around the insulated wires 4 and the interposed objects 18 in a stranded state, forming a copper braid 19 on the periphery of the polyethylene tape 17, and wrapping a polyethylene tape 17 around the copper braid 19.

Figure 7:
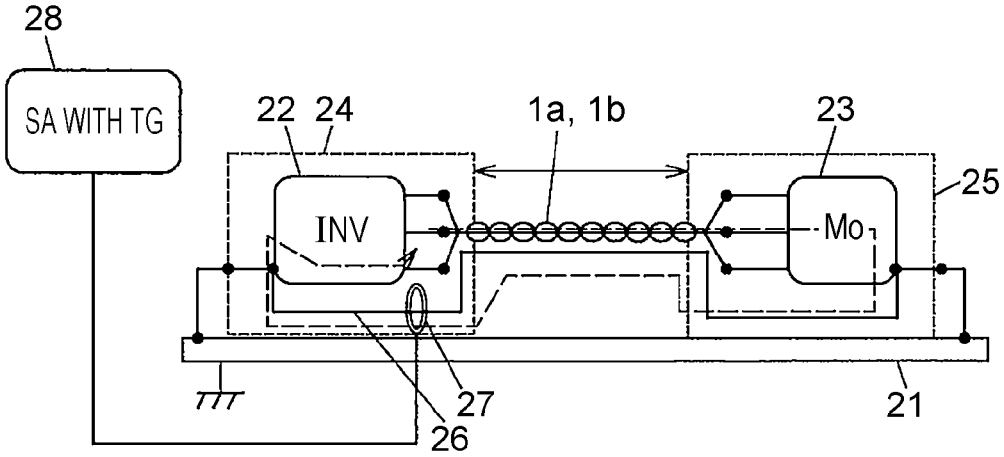
FIG. 7 illustrates a measurement system that measures electromagnetic noise radiated from a cable.

FIG. 7 illustrates a measurement system used to measure electromagnetic noises radiated from the cables 1*a* and 1*b*. This measurement system included an inverter (INV) 22 and a motor (Mo) 23 that are attached to a frame 21 made of aluminum. The inverter 22 and the motor 23 were respectively covered with shield boxes 24 and 25. A ground terminal of the inverter 22 and a ground terminal of the motor 23 were connected to each other with a drain wire 26, and a noise current that flowed through the drain wire 26 was detected by a high-frequency CT 27. The detected noise signal was analyzed by a spectrum analyzer (SA) 28.

L100-007LRF (manufactured by Hitachi Industrial Equipment Systems Co., Ltd.) was used as the inverter 22, and E4402B (manufactured by Agilent Technologies) was used as the spectrum analyzer 28. The spectrum analyzer 28 was set to RBW=3 kHz and BW=3 kHz. TL-28-S90-05Z-1R1-CL1 (manufactured by U.R.D. Co., Ltd.) was used as the high-frequency CT 27. The measurement frequency was in the range of 10 kHz to 1 MHz. The cables 1*a* and 1*b*, that is, the measurement targets, had a length of 3 m. The distance from the frame 21 to the surfaces of the cables 1*a* and 1*b* was 80 mm.

Figure 8:
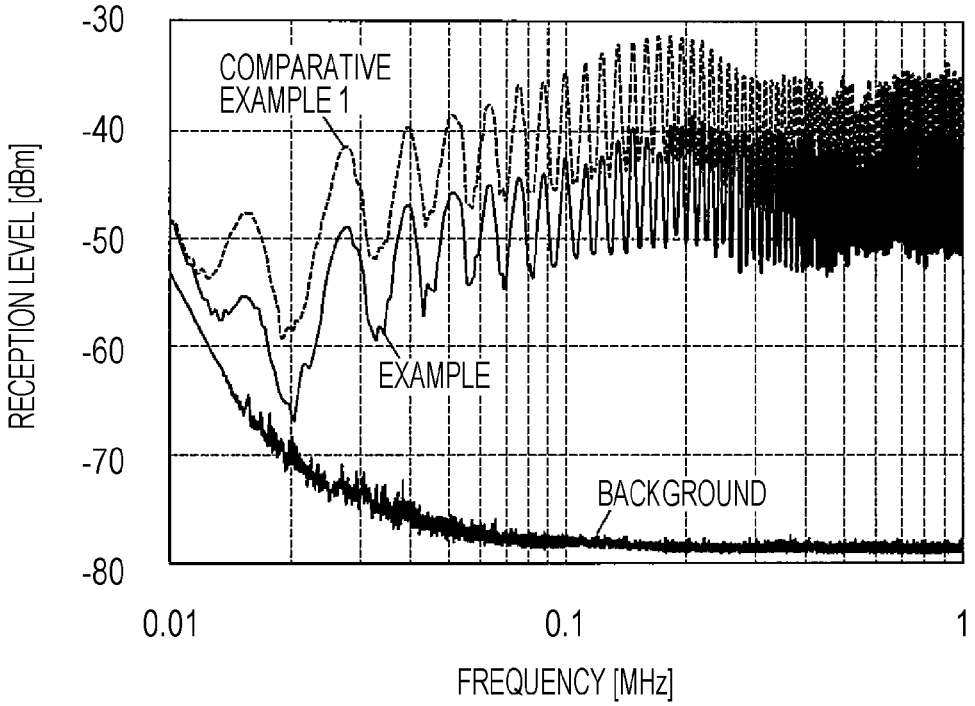
FIG. 8 is a graph showing the results of noise current measurements for the cables according to Example and Comparative Example 1.

FIG. 8 is a graph showing the results of the noise current measurements for the cable 1*a* according to Example illustrated in FIG. 6A and the cable 1*b* according to Comparative Example 1 illustrated in FIG. 6B. The noise current of the cable 1*a* according to Example is lower than that of the cable 1*b* according to Comparative Example 1 by about 5 dB in the measurement range of 10 kHz to 1 MHz.

Figure 9B:
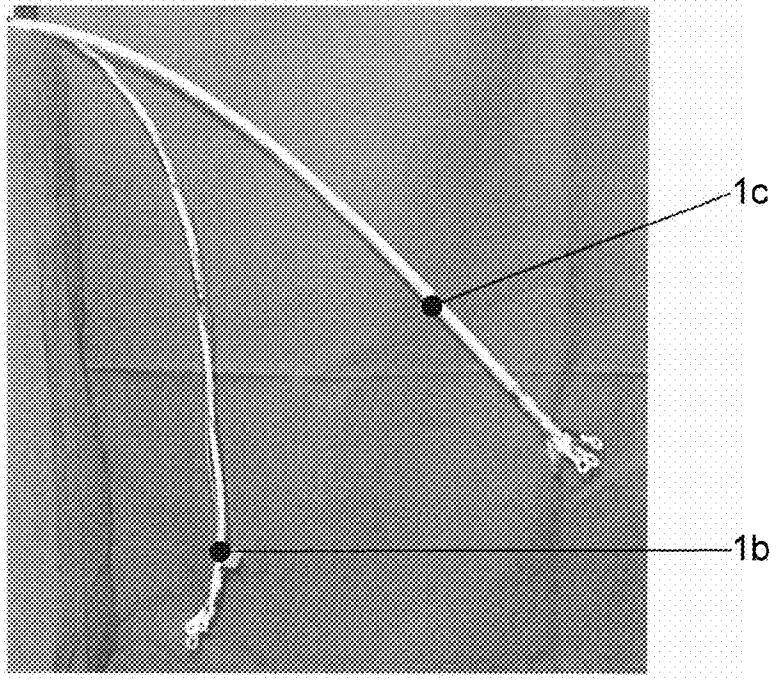
FIG. 9B is a photograph showing the flexibilities of the cables of Comparative Examples 1 and 2.
Figure 9A:
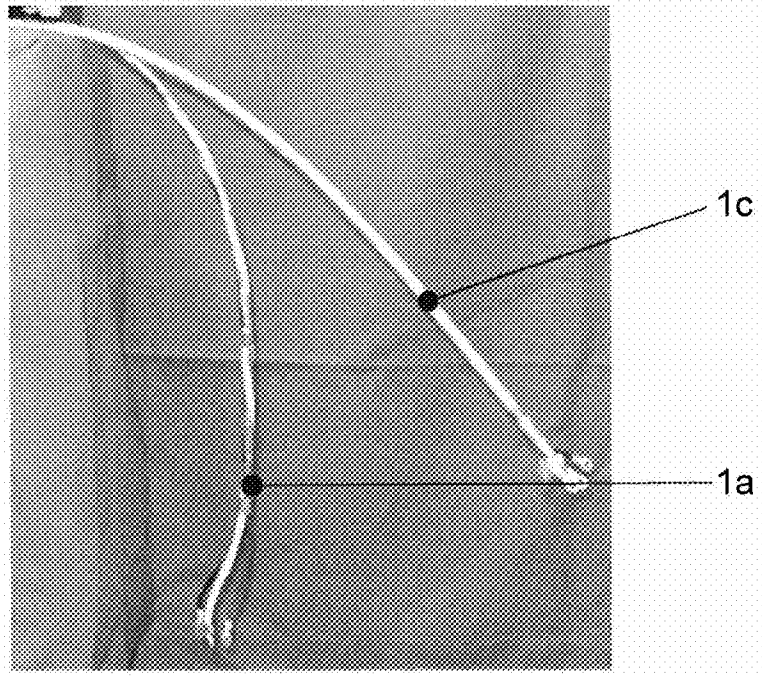
FIG. 9A is a photograph showing the flexibilities of the cables of Example and Comparative Example 2.

FIG. 9A is a photograph showing the flexibilities of the cables 1*a* and 1*c* according to Example and Comparative Example 2, and FIG. 9B is a photograph showing the flexibilities of the cables 1*b* and 1*c* according to Comparative Examples 1 and 2. Each of the cables 1*a* to 1*c* was held horizontally with one end thereof fixed, and then the other end was released. In this state, the photographs were taken from the side of the cables. As illustrated in FIGS. 9A and 9B, although the cable 1*c* of Comparative Example 2 was bent so as to extend in a direction at an angle of about 45°, the cable 1*a* of Example and the cable 1*b* of Comparative Example 1 were bent so as to extend in a direction close to the vertically downward direction. This shows that the flexibility of the cable 1*a* of Example is equivalent to that of the cable 1*b* of Comparative Example 1.

Embodiments of the present invention are not limited to the above-described embodiments, and various other embodiments are possible. For example, although a plurality of magnetic tape layers 52 are provided in the above-described embodiments, a single magnetic tape layer 52 may instead be provided. In such a case, the magnetic tape layer 52 may have a width of 5 to 50 mm, or be formed so as to extend continuously in the longitudinal direction of the cable. The magnetic tape layer 52 may be composed of a resin layer containing magnetic powder.

One or more of the components of the above-described embodiments may be omitted or modified without departing from the gist of the present invention. For example, the interposed objects may be omitted when the drain wires 5 serve also as interposed objects.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted than Applicant's intent is to encompass equivalents of all claim elements, even if amended later during prosecution.

What is claimed is:

1. A noise reduction cable, comprising:

a plurality of insulated wires, each including a conductor and an insulator that covers a periphery of the conductor; and one or more drain wires, each including a conductor and an insulator that covers a periphery of the conductor, wherein the plurality of insulated wires and the one or ore drain wires are twisted together, and a magnetic material layer is provided on a periphery of the insulator of the one or more drain wires instead of providing a magnetic material layer at a periphery of the twisted wires.

2. The noise reduction cable according to claim 1, wherein the plurality of insulated wires and the one or e drain wires are arranged at positions that are line-symmetrical with respect to a line passing through a center of a cross section of the cable.

3. The noise reduction cable according to claim 1, wherein a plurality of the magnetic material layers are provided with a predetermined interval therebetween.

4. The noise reduction cable according to claim 3, wherein the magnetic material layers are formed by wrapping pieces of magnetic material layers so that both ends of each piece of magnetic material layers overlap, and bonding the overlapping portions together by resistance welding.

5. The noise reduction cable according to claim 1, wherein the twisted wires include one or more interposed objects.

6. The noise reduction cable according to claim 1, wherein a resin tape layer is provided on the periphery of the twisted wires.

7. The noise reduction cable according to claim 6, wherein a sheath is provided on a periphery of the resin tape layer.

8. The noise reduction cable according to claim 1, wherein the magnetic material layer comprises a soft magnetic material.

9. The noise reduction cable according to claim 8, wherein the soft magnetic material comprises an amorphous alloy, a ferrite, or a soft magnetic metal.

10. The noise reduction cable according to claim 1, wherein the magnetic material layer is composed of a resin layer comprising magnetic powder.

11. The noise reduction cable according to claim 1, wherein the noise reduction cable comprises a four-core cable.

12. A noise reduction cable, comprising:

a plurality of insulated wires, each including a conductor and an insulator that covers a periphery of the conductor; and one or more drain wires, each including a conductor and an insulator that covers a periphery of the conductor, wherein the plurality of insulated wires and the one or more drain wires are twisted together, and a magnetic material layer is provided on a periphery of the insulator of the one or more drain wires instead of providing a magnetic material layer at the periphery of the twisted wires, and wherein a ratio of the drain wires to the insulation wires comprises a 1:1 ratio.

13. The noise reduction cable according to claim 12, wherein a plurality of the magnetic material layers are provided with a predetermined interval therebetween.

14. The noise reduction cable according to claim 13, wherein the magnetic material layers are formed by wrapping pieces of magnetic material layers so that both ends of each piece of magnetic material layers overlap, and bonding the overlapping portions together by resistance welding.

15. The noise reduction cable according to claim 12, wherein the magnetic material layer comprises a soft magnetic material.

16. The noise reduction cable according to claim 15, wherein the soft magnetic material comprises an amorphous alloy, a ferrite, or a soft magnetic metal.

17. The noise reduction cable according to claim 12, wherein the noise reduction cable comprises a four-core cable.

18. The noise reduction cable according to claim 12, wherein a resin tape layer is provided on a periphery of the twisted wires.

19. The noise reduction cable according to claim 12, wherein the plurality of insulated wires and the one or more drain wires are arranged at positions that are line-symmetrical with respect to a line passing through a center of a cross section of the cable.

20. The noise reduction cable according to claim 18, wherein a sheath is provided on a periphery of the resin tape layer.

* * * * *